US009607736B2

(12) United States Patent
Amano et al.

(10) Patent No.: US 9,607,736 B2
(45) **Date of Patent: *Mar. 28, 2017**

(54) INSULATED WIRE

(71) Applicants: DENSO CORPORATION, Aichi (JP); UNIMAC LTD., Mie (JP)

(72) Inventors: Yuki Amano, Nagoya (JP); Shinsuke Sugiura, Nishio (JP); Kazuomi Hirai, Inabe (JP); Yumi Nakane, Inabe (JP); Masatoshi Narita, Inabe (JP); Tatsumi Hirano, Inabe (JP); Futoshi Kanemitsu, Inabe (JP); Yasunari Ashida, Inabe (JP)

(73) Assignees: DENSO Corporation, Aichi (JP); Unimac LTD., Mie (JP)

( * ) Notice: Subject to any disclaimer, the term of this patent is extended or adjusted under 35 U.S.C. 154(b) by 126 days.

This patent is subject to a terminal disclaimer.

(21) Appl. No.: 14/597,425

(22) Filed: Jan. 15, 2015

(65) Prior Publication Data

US 2015/0206627 A1 Jul. 23, 2015

(30) Foreign Application Priority Data

Jan. 17, 2014 (JP) ..... 2014-007019

(51) Int. Cl.

| | |
|---|---|
| ***H01B 7/29*** | (2006.01) |
| ***H01B 7/04*** | (2006.01) |
| ***H01B 7/02*** | (2006.01) |
| ***H01B 3/30*** | (2006.01) |
| ***H01B 7/28*** | (2006.01) |

(52) U.S. Cl.

CPC ..... *H01B 7/292* (2013.01); *H01B 3/306* (2013.01); *H01B 7/28* (2013.01); *Y10T 428/2495* (2015.01); *Y10T 428/269* (2015.01); *Y10T 428/2933* (2015.01)

(58) Field of Classification Search

None

See application file for complete search history.

(56) References Cited

U.S. PATENT DOCUMENTS 2,286,759 A * 6/1942 Patnode ..... B05D 3/12 118/DIG. 18

4,535,105 A * 8/1985 Inaike ..... C08J 3/091 524/104

(Continued)

FOREIGN PATENT DOCUMENTS

JP 2011-009015 1/2011

*Primary Examiner* — Prashant J Khatri

(74) *Attorney, Agent, or Firm* — Harness, Dickey & Pierce, PLC

(57) ABSTRACT

According to one embodiment, an insulated wire is disclosed. The wire includes a conductor and an insulating film formed on the conductor, the insulating film including a first layer of a first polyamideimide containing an adhesion improver; a second layer of a second polyamideimide obtained by reacting an isocyanate component containing 10 to 70 mol % in total of 2,4'-diphenylmethane diisocyanate and dimer acid diisocyanate with an acid component; and a third layer of a polyimide obtained by reacting an acid component containing 50 to 80 mol % of 3,3',4,4'-biphenyl tetracarboxylic dianhydride and 20 to 50 mol % of pyromellitic anhydride with a diamine component containing 4,4'-diaminodiphenyl ether.

7 Claims, 1 Drawing Sheet

(56) References Cited

U.S. PATENT DOCUMENTS

| | | | | |
|---|---|---|---|---|
| 6,127,509 | A * | 10/2000 | Pratte | B32B 27/34<br>428/411.1 |
| 2011/0048766 | A1 * | 3/2011 | Kikuchi | C08G 73/1035<br>174/110 SR |

* cited by examiner

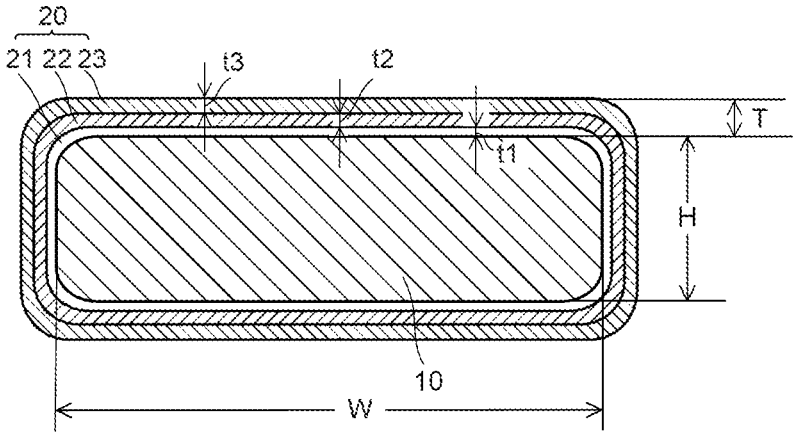
20
21 22 23
t3
t2
t1
T
H
10
W

INSULATED WIRE

CROSS-REFERENCE TO RELATED APPLICATION

This application is based upon and claims the benefit of priority from the prior Japanese Patent Application No. 2014-007019, filed on Jan. 17, 2014; the entire contents of which are incorporated herein by reference.

FIELD

Embodiments described herein relate generally to an insulated wire which may be used for a coil of a motor or the like.

BACKGROUND

As electronic and electric devices have been miniaturized in recent years, the mainstream of coils to be attached inside such devices is changing from one using a conventional enameled wire with a circular cross section (i.e., round enameled wire) to one using an enameled wire with a rectangular cross section (i.e., rectangular enameled wire). The rectangular enameled wire is made as a result that an insulating varnish is applied onto a conductor with a rectangular cross section (rectangular conductor) and baked, to form an insulating film. By using the rectangular enameled wire, a gap between the enameled wires when being wound into a coil can be made smaller (that is, a space factor of the enameled wire can be heightened), enabling miniaturization of the coil. Recently, in order to further miniaturize a coil, a diameter of an enameled wire is being made smaller.

The insulating film of the enameled wire used for the coil of the motor is required to have great flexibility, excellent heat resistance and heat deterioration resistance, and also have enough processing resistance to stand processing stress of being wound into the coil. In particular, a rectangle enameled wire with a small diameter is required to have higher processing resistance, as the processing stress is more severe. In addition, the rectangle enameled wire is required to be capable of maintaining higher voltage resistance even if it is used under a severe environment. In other words, it is required to have sufficient environmental atmosphere resistance. Such severe environments may include a high humidity and high temperature environment, an environment in which the enameled wire is in contact with oil such as an insulation oil, a machine oil, an engine oil, or a transmission oil, and/or water.

In order to satisfy the above-mentioned required characteristics, an insulated wire has been proposed in which an insulating varnish containing an adhesion improver such as highly-adhesive polyesterimide or highly-adhesive polyamideimide, is applied to a conductor and baked, and an aromatic polyamide film is formed in an outer periphery thereof. This insulated wire may have improved heat resistance and heat deterioration resistance. However, the insulated wire has little flexibility and insufficient processing resistance.

Therefore, the inventors of the present invention has conceived and developed an insulated wire in which layers of two kinds of polyamideimides with different characteristics, are laminated on the conductor, and the outermost layer of polyimider is provided. This insulated wire has great flexibility and enough processing resistance, as well as excellent heat resistance and heat deterioration resistance. However, the insulated wire still has slightly insufficient environmental atmosphere resistance. In addition, although the insulated wire has better processing resistance in comparison with the conventional insulated wire, it still leaves room for improvement in processing resistance, because the rectangle insulated wire with a small diameter is required to have higher processing resistance due to the fact that such a wire undergoes more severe processing stress when coiling.

SUMMARY

An object of the present invention is to provide an insulated wire which ensures an environmental atmosphere resistance superior enough to maintain a higher voltage resistance even if it is used under a severe environment, which ensures a processing resistance superior enough to endure a severe processing stress when coiling, and which ensures a quite superior flexibility, heat resistance and heat deterioration resistance.

According to one aspect of the present invention, there is provided an insulated wire, comprising: a conductor; and an insulating film disposed on the conductor, the insulating film comprising a first layer of a first polyamideimide containing an adhesion improver; a second layer of a second polyamideimide disposed on the first layer, the second polyamideimide being obtained by reacting an isocyanate component containing 10 to 70 mol % in total of 2,4'-diphenylmethane diisocyanate and dimer acid diisocyanate with an acid component; and a third layer of a polyimide disposed on the second layer, the polyimide being obtained by reacting an acid component containing 50 to 80 mol % of 3,3',4,4'-biphenyl tetracarboxylic dianhydride and 20 to 50 mol % of pyromellitic anhydride with a diamine component containing 4,4'-diaminodiphenyl ether.

BRIEF DESCRIPTION OF THE DRAWING

FIG. 1 illustrates a sectional view of an insulated wire according to an embodiment.

DETAILED DESCRIPTION

According to an embodiment of the present invention, there is provided an insulated wire which ensures environmental atmosphere resistance superior enough to maintain a higher voltage resistance even if it is used under a severe environment, which ensures a processing resistance superior enough to endure severe processing stress when coiling, and which ensures a quite superior flexibility, heat resistance and heat deterioration resistance.

Hereinafter, embodiments of the present invention will be described. Explanation will be done based on the drawing, but the drawing is provided merely for an illustration and the present invention is not limited by the drawing in any way.

FIG. 1 illustrates a sectional view of a rectangle enameled wire of an insulated wire according to an embodiment of the present invention.

As shown in FIG. 1, the rectangular enameled wire has a rectangular conductor 10 with a rectangular cross section formed by wire drawing, and an insulating film 20 with three-layer structure formed in sequence on the rectangular conductor 10, that is, a film formed of a first layer 21, a second layer 22, and a third layer 23.

The rectangular conductor 10 is formed of a metal wire which has a rectangular cross section, for example, with a width (W) of 2.0 to 7.0 mm and a thickness (H) of 0.7 to 3.0 mm, such as a copper wire, a copper alloy wire, an aluminum wire and an aluminum alloy wire. Four corner portions in the rectangular cross section may be chamfered or not, but in view of heightening a space factor at a time of winding into a coil, it is preferable that they are not chamfered (that is, the cross section is rectangular) or, even when they are chamfered, each radius is equal to or less than 0.4 mm. Examples of materials of the rectangular conductor 10, but are not limited to, a copper alloy, an aluminum, and an aluminum alloy, and in addition, an iron, a silver and alloys thereof. In view of a mechanical strength, a conductivity and the like, a copper or a copper alloy is preferable.

The first layer 21 is a layer of a polyamideimide containing an adhesion improver (also referred to as a highly-adhesive polyamideimide or a first polyamideimide), and can be formed as a result that a polyamideimide resin varnish containing an adhesion improver, i.e. highly adhesive polyamideimide resin varnish, is applied onto a rectangular conductor 10 and baked.

In general, the polyamideimide resin varnish can be obtained by reacting a tricarboxylic acid or a delivertive thereof react with a diisocyanate and/or a diamine in an organic solvent. Here, one whose adhesion heightened as a result of addition of an adhesion improver to such a polyamideimide resin varnish is used.

Examples of the tricarboxylic acid or the derivative thereof include trimellitic anhydride and trimellitic anhydride monochloride. Examples of the diisocyanate include aliphatic diisocyanates such as trimethylene diisocyanate, tetramethylene diisocyanate and trimethyl hexamethylene diisocyanate, and aromatic diisocyanates such as 4,4'-diphenylmethane diisocyanate, 4,4'-diphenylether diisocyanate, 2,4- or 2,6-tolylene diisocyanate, m- or p-xylene diisocyanate, and also derivatives such as the above diisocyanates blocked with phenols. Examples of the diamine include aliphatic diamines such as ethylene diamine and hexamethylene diamine, and aromatic diamines such as m-phenylene diamine, p-phenylene diamine, 2,4-diaminotoluene, 4,-4'-diamino-3,3'-dimethyl-1,1'-biphenyl, 4,4'-diamino-3,3'-didydroxy-1,1'-biphenyl, 3,4'-diaminodiphenyl ether, 4,4'-diaminodiphenyl ether, 3,3'-diaminodiphenyl sulfone, 4,4'-diaminodiphenyl sulfone, 4,4'-diaminodiphenyl sulfide, 2,2-bis(4-aminophenyl)propane, 2,2-bis(4-aminophenyl) hexafluoropropane, 1,3-bis(4-aminophenoxy)benzene, 1,4-bis(4-aminophenoxy)benzene, 4,4'-bis(4-aminophenoxy) biphenyl, 2,2-bis[4-(4-aminophenoxy)phenyl]propane, 2,2-bis[4-(4-aminophenoxy)phenyl]hexafluoropropane, bis[4-(3-aminophenoxy)phenyl]sulfone, and bis[4-(4-aminophenoxy)phenyl]sulfone, and also 2,6-diamino pyridine, 2,6-diamino-4-methyl pyridine, 4,4'-(9-fluorenylidene) dianiline and $\alpha,\alpha$-bis(4-aminophenyl)-1,3-diisopropyl benzene. Moreover, examples of the reaction solvent include aprotic polar solvents such as 2-pyrolidone, N-methyl-2-pyrolidone, and N,N-dimethyl acetamide, and phenolic solvents such as phenol, cresol and xylenol. Examples of the adhesion improvers include thiadiazole, thiazole, mercapto benzimidazole, thiophenol, thiophene, thiol, tetrazole, benzimidazole, butylated melamine and heterocyclic mercaptan.

Varieties of polyamideimide resin varnishes to which adhesion improvers are added are available commercially, and it is possible to appropriately select and use one or more from such marketed productions. Specifically, the productions are, for example, AI-505 from Totoku Toryo Co., Ltd. and HI-406A from Hitachi Chemical Co., Ltd (hereinabove, product names), and so on.

The highly adhesive polyamideimide constituting the first layer 21 preferably has a glass transition point (Tg) of 250 to 300° C., and more preferably 255 to 270° C.

The second layer 22 is a layer of a polyamideimide obtained by reacting an isocyanate component containing 2,4'-diphenylmethane diisocyanate and dimer acid diisocyanate react with an acid component (also referred to as a highly-flexible polyamideimide or a second polyamideimide), and is formed as a result that a resin varnish containing a highly-flexible polyamideimide is applied onto the first layer 21 and baked.

Hereinafter, the highly-flexible polyamideimide resin varnish which is used for forming the second layer 22 will be described.

For the highly-flexible polyamideimide resin varnish, 2,4'-diphenylmethane diisocyanate (2,4'-MDI) and dimer acid diisocyanate are used as the isocyanate component. As a result of using the above isocyanate component, the second layer 22 superior in a flexibility is formed, so that a superior processing resistance can be given to an insulated wire. Preferably, the sum of the 2,4'-MDI and the dimmer acid diisocyanate is 10 to 70 mol % of the isocyanate component, and more preferably 30 to 60 mol %.

Examples of other isocyanates to be used in combination with the above isocyanates are 4,4'-diphenylmethane diisocyanate (4,4'-MDI), 3,4'-diphenylmethane diisocyanate, 3,3'-diphenylmethane diisocyanate, 2,3'-diphenylmethane diisocyanate, 2,2'-diphenylmethane diisocyanate, tolylene diisocyanate (TDI), diphenylether diisocyanate, naphthalene diisocyanate, phenylene diisocyanate, xylylene diisocyanate, diphenylsulfone diisocyanate, bitolylene diisocyanate and dianisidine diisocyanate, and isomers thereof. Further, there can also be combined aliphatic diisocyanates such as hexamethylene diisocyanate, isopholone diisocyanate, methylene dicyclohexyl diisocyanate, xylylene diisocyanate and cyclohexane diisocyanate; polyfunctional isocyanates such as triphenylmethane triisocyanate; polymers such as polymeric isocyanate and tolylene diisocyanate.

Examples of the acid component are aromatic tetracarboxylic dianhydrides such as trimellitic anhydride (TMA), pyromellitic dianhydride (PMDA), benzophenone tetracarboxylic dianhydride (BTDA), biphenyl tetracarboxylic dianhydride, diphenylsulfone tetracarboxylic dianhydride (DSDA) and oxydiphthalic dianhydride, and isomers thereof; alicyclic tetracarboxylic dianhydrides such as butanetetracarboxylic dianhydrides and 5-(2,5-dioxotetrahydro-3-furanyl)-3-methyl-3-cyclohexene-1,2-dicarboxylic anhydride; tricarboxylic acids and isomers thereof such as trimesic acid and tris (2-carboxyethyl)isocyanurate (CIC acid). Among the above, trimellitic anhydride (TMA), which is inexpensive and superior in safety, is preferable.

Polycarboxylic acids may be added along with the above-described isocyanate component and acid component. Examples of the polycarboxylic acids are aromatic dicarboxylic acids such as terephthalic acid and isophthalic acid, aromatic tricarboxylic acids such as trimellitic acid and hemimellitic acid, aliphatic polycarboxylic acids such as dimer acid.

Examples of solvents to make the isocyanate component react with the acid component include aprotic polar solvents such as 2-pyrrolidone, N-methyl-2-pyrrolidone (NMP) and N,N-dimethylacetamide, phenolic solvents such as phenol, cresol and xylenol.

When reacting the isocyanate component with the acid component, reactive catalysts such as amines, imidazoles and imidazolines may be used. Preferably, the reactive catalysts are those that do not reduce a stability of the resin varnish.

Preferably, the highly-flexible polyamideimide has a glass transition point (Tg) of 200 to 270° C., and more preferably 230 to 260° C.

The third layer 23 is a layer of a polyimide obtained by reacting an acid component containing 50 to 80 mol % of 3,3',4,4'-biphenyl tetracarboxylic dianhydride (BPDA) and 20 to 50 mol % of pyromellitic anhydride with an isocyanate component containing 4,4'-diaminodiphenyl ether, and is formed as a result that a resin varnish containing such a polyimide is applied onto the second layer 22 and baked.

Hereinafter, the polyimide resin varnish used for forming the third layer 23 will be described.

For the polyimide resin varnish, 3,3',4,4'-biphenyl tetracarboxylic dianhydride and pyromellitic anhydride are used as the isocyanate component. The ratios of amount of 3,3',4,4'-byphenyl tetracarboxylic dianhydride and pyromellitic anhydride relative to the total amount of the acid component are 50 to 80 mol % and 20 to 50 mol % respectively. The polyimide resin varnish, if it is prepared within such range of the acid components, is capable of giving superior environmental atmosphere resistance and processing resistance to the insulating film. Preferably, the ratios of amount of 3,3',4,4'-byphenyl tetracarboxylic dianhydride and pyromellitic anhydriderelative to the total amount of the acid component are 55 to 65 mol % and 35 to 45 mol % respectively.

4,4'-Diaminodiphenyl ether is used as a diamine component to be reacted with the above acid component. 4,4'-Diaminodiphenyl ether is preferably 80 mol % or more of the diamine component, and more preferably 90 mol % or more. Yet preferably, 4,4'-diaminodiphenyl ether is solely used as the diamine component.

Suitable examples of other diamines to be used in combination with the above diamine are aromatic diamines such as m-phenylenediamine, p-phenylenediamine, 2,4-diaminotoluene, 4,4'-diamino-3,3'-dimethyl-1,1'-biphenyl, 4,4'-diamino-3,3'-dihydroxy-1,1'-biphenyl, 3,4'-diaminodiphenyl ether, 4,4'-diaminodiphenyl ether, 3,3'-diaminodiphenyl sulfone, 4,4'-diaminodiphenyl sulfone, 4,4'-diaminodiphenyl sulfide, 2,2-bis(4-aminophenyl)propane, 2,2-bis(4-aminophenyl)hexafluoro propane, 1,3-bis(4-aminophenoxy)benzene, 1,4-bis(aminophenoxy)benzene, 4,4'-bis(4-aminophenoxy)biphenyl, 2,2-bis[4-(4-aminophenoxy)phenyl] propane, 2,2-bis[4-(4-aminophenoxy)phenyl]hexafluoro propane, bis[4-(3-aminophenoxy)phenyl]sulfone and bis[4-(4-aminophenoxy)phenyl]sulfone.

Examples of the solvent to make the above acid component react with the diamine component include aprotic polar solvents such as 2-pyrolidone, N-methyl-2-pyrolidone (NMP) and N,N-dimethylacetamide (DMAc), and phenolic solvents such as phenol, cresol and xylenol.

When reacting the acid component with the diamine component, reactive catalysts such as amines, imidazoles and imidazolines can be used. Preferably, the reactive catalysts are those that do not reduce a stability of the resin varnish.

As described above, the first layer 21, the second layer 22, and the third layer 23 can be formed as a result that the highly-adhesive polyamideimide resin varnish, the highly-flexible polyamideimide resin varnish, and the polyimide resin varnish are applied in sequence, respectively, onto the rectangular conductor 10 and baked. Methods for applying and baking the respective resin varnishes are not limited in particular, but there can be used methods known in general, for example, a method in which a rectangular conductor or a rectangular conductor where a first layer or a second layer has been formed is made to pass through a tank containing a resin varnish and thereafter baked in a baking furnace.

With regard to respective layer thicknesses (t1, t2 and t3) of the first layer 21, the second layer 22, and the third layer 23, it is preferable that a thickness of a sum thereof, that is, a thickness (T) of the insulating film 20 being 60 to 200 μm, the first layer 21 is 10 to 20%, the second layer 22 is 10 to 75%, and the third layer 23 is 10 to 75% in a proportion of each layer in relation to the thickness of the insulating film 20. When the thickness of the first layer 21 is less than a range described above, an adhesion to the rectangular conductor 10 is reduced and a peeling from the rectangular conductor 10 occurs. When the thickness of the second layer 22 is less than a range described above, a processing resistance cannot be improved sufficiently. When the thickness of the third layer 23 is less than a range described above, a moist heat resistance, an environmental atmosphere resistance and a processing resistance are reduced, as well as a heat resistance and a heat deterioration resistance. When the thickness (T) of the insulating film 20 is less than 60 μm, a partial discharge property is insufficient, and when the thickness exceeds 200 μm, the insulating film 20 is too thick and miniaturization of a coil is difficult. More preferably, the thickness (T) of the insulating film 20 is 60 to 160 μm, and more preferably, the first layer 21 is 10 to 20%, the second layer 22 is 55 to 75%, and the third layer 23 is 15 to 30% in the proportion of each layer in relation to the thickness of the insulating film 20.

The small-sized rectangular enameled wire of the present embodiment has, on the rectangular conductor 10, the insulating film 20 constituted by the first layer 21 of the polyamideimide containing the adhesion improver, the second layer 22 of the second polyamideimide obtained by reacting the isocyanate component containing 10 to 70 mol % in total of the 2,4'-diphenylmethane diisocyanate and the dimer acid diisocyanate with the acid component, the second layer 22 provided on the first layer 21, and the third layer 23 of the polyimide obtained by reacting the acid component containing 50 to 80 mol % of 3,3',4,4'-biphenyl tetracarboxylic dianhydride and 20 to 50 mol % of pyromellitic anhydride with the diamine component containing 4,4'-diaminodiphenyl ether, the third layer 23 provided on the second layer 22. Thus, even if the rectangle enameled wire with a small diameter according to the present embodiment is used under the severe environment including a high humidity and high temperature environment, an environment in which the enameled wire is constantly in contact with oil such as an insulation oil, a machine oil, an engine oil, or a transmission oil, and/or water in a soak manner, the rectangle enameled wire is still capable of maintaining higher voltage resistance. In other words, if, for example, an existing rectangle enameled wire is soaked in the oil such as an insulation oil, there is a risk that the insulating characteristics of the insulating film can be deteriorated. In contrast, according to the rectangle enameled wire of the present embodiment, the insulating characteristics of the insulating film are not deteriorated. Likewise, if an existing rectangle enameled wire is used under the high humidity and high temperature environment, there is also a risk that the insulating characteristics of the insulating film can be deteriorated. In contrast, according to the rectangle enameled wire of the present embodiment, the insulating characteristics of the insulating film are not deteriorated.

Furthermore, the rectangle enameled wire according to the present embodiment is provided with the particular insulating film 20 as described above, thus the insulating film according to the present embodiment is, even the rectangle enameled wire has small diameter, free from peeling due to the severe processing stress of being is wound into the coil. Yet furthermore, the rectangle enameled wire has a superior flexibility, processing resistance and heat deterioration resistance.

As mentioned above, one embodiment according to the present invention has been described. However, the present invention is not limited to the above describe embodiment as is. Instead, when it is implemented, the present invention can be embodied by modifying the elements without departing from the scope of the present invention. For example, although the above mentioned embodiment has been described as an example of the present invention being applied to the rectangle enameled wire, it is needless to say that the invention can be instead applied to the round enameled wire that uses ordinary round conductor.

According to the insulated wire of the present invention, a higher voltage resistance characteristic can be maintained even it is used under the severe environment. Thus, it is useful for winding wire of a motor which is used in motor vehicles. As such, even it has a small diameter, the insulated wire according to the present embodiment has an excellent processing resistance. Thus, it is useful for the insulated wire which uses the conductor with a small diameter. More particularly, it is useful for the insulated wire which uses the rectangle conductor which is subjected to extremely severe processing stress when wound into the coil.

EXAMPLES

Hereinafter, the present invention will be described in more great detail with referring to examples. However, it should be noted that the present invention is not limited to the particular examples. In the following description, the term "parts" means "parts by mass", unless otherwise specified.

[Preparation of Polyamideimide Resin Varnish]

A mixture of 0.60 mol of 2,4'-MDI and 0.30 mol of 4,4'-MDI, and 0.10 mol of dimer acid diisocyanate (DDI), as the isocyanate component, and 1.05 mol of trimellitic anhydride, as the acid component, were input into a flask which was provided with a stirring machine, a nitrogen influx tube and a heating and cooling equipment. 150 parts of N-methyl-2-pyrolidone as a solvent were input with respect to total 100 parts of the acid component and the isocyanate component, then the temperature of the content was elevated in two hours from the room temperature to 140° C. with being stirred in the nitrogen atmosphere. After reacting at the elevated temperature for three hours, it was diluted with 83 parts of N,N-dimethyl hormamide (DMF), then cooled down to the room temperature. Thus, the polyamideimide resin varnish of which resin component was 30 mass % (highly-flexible PAI) was obtained.

Preparation of Polyimide Resin Varnish

Preparation Example 1

0.60 mol of 3,3',4,4'-biphenyl tetracarboxylic dianhydride (BPDA) and 0.4 mol of pyromellitic anhydride (PMDA), as the acid component, and 1.02 mol of 4,4'-diamino diphenyl ether (DDE), as the diamine component, were input into a flask which was provided with a stirring machine, a nitrogen influx tube and a heating and cooling equipment. 400 parts of N-methyl-2-pyrolidone as a solvent were input with respect to total 100 parts of the acid component and the diamine component. After reacting in the nitrogen atmosphere for two hours, the polyimide resin varnish with a resin content of 20 mass % (C-1) was obtained.

Preparation Examples 2 to 6

Polyimide resin varnishes (C-2) to (C-6) were obtained in similar methods as in preparation example 1, with proportions of acid components being changed as shown in Table 1.

TABLE 1

| | | Polyimide resin varnish | | | | | |
|---|---|---|---|---|---|---|---|
| | | C-1 | C-2 | C-3 | C-4 | C-5 | C-6 |
| Acid component (mol) | BPDA | 0.60 | 0.40 | 0.50 | 0.70 | 0.80 | 0.90 |
| | PMDA | 0.40 | 0.60 | 0.50 | 0.30 | 0.20 | 0.10 |
| Diamine component (mol) | DDE | 1.02 | 1.02 | 1.02 | 1.02 | 1.02 | 1.02 |

Manufacturing of Insulated Electric Wire

Example 1

Onto a rectangular copper conductor with a thickness of 1.9 mm and a width of 3.4 mm, a polyamideimide resin varnish containing an adhesion improver (product name: AI-505, from Totoku Toryo Co., Ltd.; abbreviated to "HAPAI" in the following tables) was applied and baked, to form a film (first layer) with a thickness of 20 μm. Next, onto the first layer, the above highly-flexible PAI (abbreviated to "HFPAI" in the following tables) was applied and baked, to form a film (second layer) with a thickness of 60 μm. Onto the second layer, a polyamideimide resin varnish (C-1) shown in Table 1 was applied and baked, to form a film (third layer) with a thickness of 20 μm, so that an insulated electric wire was obtained.

Examples 2 to 19

An insulated electric wire was obtained similarly to in example 1, except that at least one condition of a kind or a size of a rectangular conductor, a kind of a polyimide resin varnish used for forming the third layer, and film thicknesses of the first layer to the third layer was changed.

Comparative Examples 1 to 9

An insulated electric wire was obtained by a constitution and dimension shown in Table 3.

With regard to each insulated electric wire obtained, each property was measured and evaluated in methods described below.

[Glass Transition Point (Tg)]

Glass transition points (Tg) of materials constituting the first and second layers are measured by using a thermomechanical analyzer.

[Heat Deterioration Resistance]

After an insulated electric wire sample with a length of 30 cm is heat-deteriorated at 250° C. for 48 hours, a tensile test is performed under a condition of a gage length of 10 cm and a tensile speed of 3 mm/min, and an evaluation is done according to the criteria below.

A: neither fracture nor crack of an insulating film occurs by an elongation of equal to or more than 7 mm.

B: neither fracture nor crack of an insulating film occurs by an elongation of equal to or more than 3 mm and less than 7 mm.

C: neither fracture nor crack of an insulating film occurs by an elongation of equal to or more than 2 mm and less than 3 mm.

D: a fracture or a crack of an insulating film occurs by an elongation of less than 2 mm.

[Processing Resistance]

An insulated electric wire sample with a length of 25 cm is extended by 30% and an edgewise bending test is performed, and then an evaluation is done according to the criteria below (n=40).

A: no crack occurs.

B: a crack occurrence rate is less than 5%.

C: a crack occurrence rate is equal to or more than 5% and less than 10%.

D: a crack occurrence rate is equal to or more than 10%.

[Adhesion]

A 180° peeling test of an insulating film and a conductor is performed, and an adhesion (g/mm) of the insulating film is measured.

[Abrasion Resistance]

A reciprocal abrasion test between insulated wires is performed under a condition of an abrasion length of 4000 m and a load of 1.2 kg by using an abrasion tester, and an evaluation is done according to the criteria below.

A: a film remaining rate is about 100%.

B: a film remaining rate is equal to or more than 80%.

C: a film remaining rate is equal to or more than 50% and less than 80%.

D: a film remaining rate is less than 50%.

[Oil Resistance]

An insulated electric wire sample with a length of 25 cm is extended by predetermined length, and is soaked in the transmission oil at predetermined temperature for predetermined period of time. Then the crack incidence rates are examined (n=15).

[Moist Heat Resistance]

After leaving an insulated wire sample with a length of 25 cm in the environment of predetermined temperature and predetermined humidity for predetermined period of time, a flatwise bending test is carried out. Then an evaluation thereof is done according to the criteria below (n=40).

A: neither fracture nor crack of the insulating film occurred with bending radius less than 5 mmϕ.

B: neither fracture nor crack of the insulating film occurred with bending radius equal to or greater than 5 mmϕ and less than 10 mmϕ.

C: neither fracture nor crack of the insulating film occurred with bending radius equal to or greater than 10 mmϕ and less than 20 mmϕ.

D: fracture or crack of the insulating film occurred with bending radius equal to or greater than 20 mmϕ.

Measured results of the above are shown in Table 2 to Table 5 with a constitution, a dimension and the like of each insulated wire.

TABLE 2

| | Material** | | | | Conductor Size (mm) | | Thickness of Insulating Film (μm)* | | | |
|---|---|---|---|---|---|---|---|---|---|---|
| | Conductor | 1st Layer | 2nd Layer | 3rd Layer | height | Width | Total | 1st Layer | 2nd Layer | 3rd Layer |
| Ex. 1 | Cu | HAPAI | HFPAI | C-1 | 1.9 | 3.4 | 100 | 20 (20) | 60 (60) | 20 (20) |
| Ex. 2 | Cu | HAPAI | HFPAI | C-1 | 2.0 | 3.5 | 140 | 20 (20) | 95 (68) | 25 (18) |
| Ex. 3 | Cu | HAPAI | HFPAI | C-1 | 2.0 | 3.5 | 160 | 24 (15) | 108 (68) | 28 (18) |
| Ex. 4 | Cu | HAPAI | HFPAI | C-1 | 1.6 | 2.4 | 100 | 15 (15) | 60 (60) | 25 (25) |
| Ex. 5 | Cu | HAPAI | HFPAI | C-1 | 1.9 | 3.4 | 100 | 15 (15) | 25 (25) | 60 (60) |
| Ex. 6 | Cu | HAPAI | HFPAI | C-1 | 1.9 | 3.4 | 100 | 15 (15) | 45 (45) | 40 (40) |
| Ex. 7 | Cu | HAPAI | HFPAI | C-1 | 1.9 | 3.4 | 100 | 20 (20) | 55 (55) | 25 (25) |
| Ex. 8 | Cu | HAPAI | HFPAI | C-1 | 1.9 | 3.4 | 100 | 20 (20) | 65 (65) | 15 (15) |
| Ex. 9 | Cu | HAPAI | HFPAI | C-1 | 1.9 | 3.4 | 100 | 20 (20) | 75 (75) | 5 (5) |
| Ex. 10 | Cu | HAPAI | HFPAI | C-1 | 1.9 | 3.4 | 100 | 20 (20) | 8 (8) | 72 (72) |
| Ex. 11 | Cu | HAPAI | HFPAI | C-1 | 1.9 | 3.4 | 100 | 15 (15) | 80 (80) | 5 (5) |
| Ex. 12 | Cu | HAPAI | HFPAI | C-1 | 1.9 | 3.4 | 100 | 5 (5) | 65 (65) | 30 (30) |
| Ex. 13 | Cu | HAPAI | HFPAI | C-1 | 2.0 | 3.5 | 100 | 20 (20) | 60 (60) | 20 (20) |
| Ex. 14 | Cu | HAPAI | HFPAI | C-3 | 1.9 | 3.4 | 100 | 20 (20) | 60 (60) | 20 (20) |
| Ex. 15 | Cu | HAPAI | HFPAI | C-4 | 1.9 | 3.4 | 100 | 20 (20) | 60 (60) | 20 (20) |
| Ex. 16 | Cu | HAPAI | HFPAI | C-5 | 1.9 | 3.4 | 100 | 20 (20) | 60 (60) | 20 (20) |
| Ex. 17 | Cu | HAPAI | HFPAI | C-1 | 1.9 | 3.4 | 220 | 44 (20) | 132 (60) | 44 (20) |
| Ex. 18 | Al | HAPAI | HFPAI | C-1 | 1.9 | 3.4 | 100 | 20 (20) | 60 (60) | 20 (20) |
| Ex. 19 | Al | HAPAI | HFPAI | C-1 | 1.9 | 3.4 | 100 | 15 (15) | 60 (60) | 25 (20) |

*Value in the bottom of each cell is thickness ratio relative to total thickness of the insulation film (unit: %).

**HAPAI: highly-adhesive PAI; HFPAI: highly-flexible PAI.

TABLE 3

| | Material** | | | | Conductor Size (mm) | | Thickness of Insulating Film (μm)* | | | |
|---|---|---|---|---|---|---|---|---|---|---|
| | Conductor | 1st Layer | 2nd Layer | 3rd Layer | height | Width | Total | 1st Layer | 2nd Layer | 3rd Layer |
| Comp. Ex. 1 | Cu | HAPAI | HFPAI | C-6 | 1.9 | 3.4 | 100 | 20 (20) | 65 (65) | 15 (15) |
| Comp. Ex. 2 | Cu | HAPAI | HFPAI | C-2 | 1.9 | 3.5 | 100 | 20 (20) | 65 (60) | 15 (15) |
| Comp. Ex. 3 | Cu | HAPAI | HFPAI | C-2 | 1.9 | 3.5 | 100 | 5 (5) | 75 (75) | 20 (20) |
| | | — | | | | | | | | |
| Comp. Ex. 4 | Cu | HAPAI | HFPAI | C-2 | 1.9 | 2.4 | 100 | 10 (10) | 10 (10) | 80 (80) |
| Comp. Ex. 5 | Cu | HAPAI | HFPAI | C-2 | 1.9 | 3.4 | 100 | 30 (30) | 5 (5) | 65 (65) |
| Comp. Ex. 6 | Cu | g.u.PAI | — | — | 1.0 | 5.0 | 50 | 50 (100) | — | — |
| Comp. Ex. 7 | Cu | HAPAI | HFPAI | — | 1.9 | 3.4 | 50 | 35 (70) | 15 (30) | — |
| Comp. Ex. 8 | Cu | HAPAI | HFPAI | g.u.PI | 1.9 | 3.4 | 100 | 20 (20) | 60 (60) | 20 (20) |
| Comp. Ex. 9 | Al | HAPAI | HFPAI | g.u.PI | 1.9 | 3.4 | 100 | 20 (20) | 65 (65) | 15 (15) |

*Value in the bottom of each cell is thickness ratio relative to total thickness of the insulation film (unit: %).

**HAPAI: highly-adhesive PAI; HFPAI: highly-flexible PAI; g.u.PAI: general-use PAI (product name: HI-406, from Hitachi Chemical Co., Ltd.); g.u.PI: general-use PI (product name: Torayneece #3000, from Toray Industries, Inc.).

TABLE 4

| | Glass Transition Point (° C.) | | Heat | Processing | | | | |
|---|---|---|---|---|---|---|---|---|
| | 1st layer | 2nd layer | Deterioration Resistance | Resistance (Flexibility) | Adhesion (g/mm) | Abrasion Resistance | Oil Resistance | Moist Heat Resistance |
| Ex. 1 | 266 | 246 | A | A | 49 | A | 0/15 | A |
| Ex. 2 | 266 | 246 | A | A | 64 | A | 0/15 | A |
| Ex. 3 | 266 | 246 | A | A | 53 | A | 0/15 | A |
| Ex. 4 | 266 | 246 | A | A | 44 | A | 0/15 | A |
| Ex. 5 | 266 | 246 | A | B | 51 | A | 0/15 | A |
| Ex. 6 | 266 | 246 | A | B | 55 | A | 0/15 | A |
| Ex. 7 | 266 | 246 | A | A | 58 | A | 0/15 | A |
| Ex. 8 | 266 | 246 | A | A | 65 | A | 0/15 | A |
| Ex. 9 | 266 | 246 | B | A | 62 | A | 0/15 | B |
| Ex. 10 | 266 | 246 | A | B | 64 | A | 0/15 | A |
| Ex. 11 | 266 | 246 | B | A | 55 | A | 0/15 | B |
| Ex. 12 | 266 | 246 | A | B | 43 | A | 0/15 | A |
| Ex. 13 | 266 | 232 | A | A | 59 | A | 0/15 | B |
| Ex. 14 | 266 | 222 | A | A | 61 | A | 0/15 | B |
| Ex. 15 | 266 | 270 | B | A | 56 | A | 0/15 | A |
| Ex. 16 | 266 | 256 | B | A | 65 | A | 0/15 | A |
| Ex. 17 | 266 | 200 | A | B | 65 | A | 0/15 | A |
| Ex. 18 | 266 | 246 | A | A | 54 | A | 0/15 | A |
| Ex. 19 | 266 | 246 | A | A | 46 | A | 0/15 | A |

45

TABLE 5

| | Glass Transition Point (° C.) | | Heat | Processing | | | | |
|---|---|---|---|---|---|---|---|---|
| | 1st layer | 2nd layer | Deterioration Resistance | Resistance (Flexibility) | Adhesion (g/mm) | Abrasion Resistance | Oil Resistance | Moist Heat Resistance |
| Comp. Ex. 1 | 266 | 246 | C | A | 65 | A | 0/15 | A |
| Comp. Ex. 2 | 266 | 246 | A | A | 65 | A | 6/15 | C |
| Comp. Ex. 3 | 266 | 246 | A | A | 18 | B | 6/15 | C |
| Comp. Ex. 4 | 266 | 246 | A | C | 56 | D | 6/15 | C |
| Comp. Ex. 5 | 266 | 246 | A | D | 62 | C | 6/15 | C |
| Comp. Ex. 6 | 288 | — | D | D | 7 | B | 15/15 | D |
| Comp. Ex. 7 | 266 | 246 | C | D | 55 | B | 15/15 | D |
| Comp. Ex. 8 | 266 | 246 | A | A | 49 | A | 15/15 | B |
| Comp. Ex. 9 | 266 | 246 | A | A | 46 | A | 15/15 | B |

As apparent from the above Tables 2 to 5, the insulated wires of the above examples have an efficient environmental atmosphere resistance and processing resistance, as well as an efficient heat resistance and heat deterioration resistance.

What is claimed is:

1. An insulated wire, comprising:

a conductor; and an insulating film disposed on the conductor, the insulating film comprising a first layer of a first polyamideimide containing an adhesion improver;

a second layer of a second polyamideimide disposed on the first layer, the second polyamideimide being obtained by reacting an isocyanate component containing 10 to 70 mol % in total of 2,4'-diphenylmethane diisocyanate and dimer acid diisocyanate with an acid component; and a third layer of a polyimide disposed on the second layer, the polyimide being obtained by reacting an acid component containing 50 to 80 mol % of 3,3',4,4'-biphenyl tetracarboxylic dianhydride and 20 to 50 mol % of pyromellitic anhydride with a diamine component containing 4,4'-diaminodiphenyl ether, wherein, with regard to a proportion of thicknesses of the first to third layers in relation to the total thickness of the insulating film, the first layer is 10 to 20%, the second layer is 10 to 75%, and the third layer is 10 to 75%.

2. The insulated wire according to claim 1, wherein the acid component of the third layer contains 55 to 65 mol % of 3,3',4,4'-biphenyl tetracarboxylic dianhydride and 35 to 45 mol % of pyromellitic anhydride.

3. The insulated wire according to claim 1, wherein, the second layer is 55 to 75%, and the third layer is 15 to 30%.

4. The insulated wire according to claim 1, wherein a glass transition point (Tg) of the second polyamideimide is 200 to 270° C.

5. The insulated wire according to claim 1, wherein the total thickness of the insulating film is 60 to 200 μm.

6. The insulated wire according to claim 1, wherein the conductor is a rectangle conductor.

7. The insulated wire according to claim 6, wherein the rectangle conductor has a rectangular cross section of 2.0 to 7.0 mm in width and 0.7 to 3.0 mm in height.

* * * * *